US010315331B2

(12) United States Patent
Klaas

(10) Patent No.: US 10,315,331 B2
(45) Date of Patent: Jun. 11, 2019

(54) THERMO TREATMENT PROCESS FOR WOOD

(71) Applicant: WTT Holding ApS, Brande (DK)

(72) Inventor: Peter Klaas, Martofte (DK)

(73) Assignee: WTT Holding ApS, Brande (DK)

( * ) Notice: Subject to any disclaimer, the term of this patent is extended or adjusted under 35 U.S.C. 154(b) by 0 days.

(21) Appl. No.: 15/642,543

(22) Filed: Sep. 14, 2017

(65) Prior Publication Data

US 2018/0015636 A1 Jan. 18, 2018

(30) Foreign Application Priority Data

Jul. 15, 2016 (DK) ..... 2016 70528

(51) Int. Cl.

| | |
|---|---|
| ***B27K 5/00*** | (2006.01) |
| ***F26B 3/04*** | (2006.01) |
| ***F26B 21/10*** | (2006.01) |
| ***F26B 21/14*** | (2006.01) |

(52) U.S. Cl.

CPC ..... *B27K 5/001* (2013.01); *B27K 5/009* (2013.01); *F26B 3/04* (2013.01); *F26B 21/10* (2013.01); *F26B 21/14* (2013.01); *F26B 2210/16* (2013.01)

(58) Field of Classification Search

CPC .. F26B 3/04; F26B 21/10; F26B 21/14; F26B 2210/16; B27K 5/001; B27K 5/009

USPC ..... 34/389

See application file for complete search history.

(56) References Cited

U.S. PATENT DOCUMENTS

| | | | | |
|---|---|---|---|---|
| 2,435,218 | A * | 2/1948 | Hudson | B27K 5/04 34/470 |
| 3,395,062 | A * | 7/1968 | Peters | B05D 7/06 156/244.23 |
| 4,377,040 | A | 3/1983 | Giebeler | |
| 8,015,725 | B2 * | 9/2011 | Vives | F26B 3/30 156/238 |
| 2003/0084962 | A1 | 5/2003 | Abe | |
| 2005/0284945 | A1 * | 12/2005 | Laurencot | F26B 21/02 236/44 C |
| 2008/0178490 | A1 | 7/2008 | Matsunaga | |
| 2010/0143739 | A1 * | 6/2010 | Willems | B27K 1/00 428/541 |

(Continued)

FOREIGN PATENT DOCUMENTS

| | | |
|---|---|---|
| CA | 1159643 A | 1/1984 |
| EP | 2196295 A1 | 6/2010 |
| EP | 2998087 A2 | 3/2016 |

(Continued)

*Primary Examiner* — Stephen M Gravini

(74) *Attorney, Agent, or Firm* — James Creighton Wray; Meera P. Narasimhan

(57) ABSTRACT

Thermo treatment process for wood comprising the following steps:

a. Placing the wood batch to be treated in a treatment chamber;
b. Exchanging the atmosphere inside the treatment chamber by evacuating the air, replacing the evacuated air by an inert gas atmosphere in gas form, at 8 to 12 bar pressure;
c. Heating the inert gas atmosphere up to 165 to 175° C.,
d. increasing the pressure in the inert gas atmosphere to 14-16 bar;
e. maintaining the temperature in step c. and the pressure in step d. for from 90 to 150 minutes;
f. cooling the inert gas atmosphere to a temperature of 20 to 35° C.
g. retrieving the treated wood batch.

5 Claims, 25 Drawing Sheets

(56) References Cited

U.S. PATENT DOCUMENTS

| | | | | |
|---|---|---|---|---|
| 2011/0020568 | A1* | 1/2011 | Danchenko | B27K 5/009<br>428/17 |
| 2018/0015636 | A1* | 1/2018 | Klaas | B27K 5/001 |

FOREIGN PATENT DOCUMENTS

| | | | | |
|---|---|---|---|---|
| JP | 2013180460 | A | | 9/2013 |
| KR | 20110039031 | A | * | 4/2011 |

* cited by examiner

Product properties

| | |
|---|---|
| Product | Wood_Spruce |
| Product temperature (at which the properties are calculated) | 146 [°C] |
| Water content (at which the properties are calculated) | 12 [%] |
| Density | 527 [kg/m$^3$] |
| Specific heat capacity | 2,639 [kJ/kg-K] |
| Conductivity | 0,2173 [W/m-K] |

Fig. 3A

| Volume and flow velocity | |
|---|---|
| Number of wood pieces horizontally | 11 [-] |
| Number of wood pieces vertically | 17 [-] |
| Number of wood pieces totally | 187 [-] |
| Total product volume | 11,9 [$m^3$] |
| Height stack | 1,12 [m] |
| Width stack | 1,11 [m] |
| Circulated gas volume | 6000 [$m^3/h$] |
| Gas cooling - one pass(@ average effect) | 66 [K] |
| Gas velocity across stack | 0.6 [m/s] |
| Pressure loss across stack | 15 [Pa] |

Fig. 3A (continued)

| Energy and effect | |
|---|---|
| Total volume thermal oil | 300 [L] |
| Thermal oil (energy requirement) | 27 [kWh] |
| Gas (energy requirement) | 9 [kWh] |
| Autoclave (energy requirement) | 192 [kWh] |
| Product | 558 [kWh] |
| Loss | 5 [kWh] |
| Totally | 786 [kWh] |
| Time at present condition (heating/cooling) | 2400 [s] |
| Time in hours and minutes | 0[h] 40 [min] |
| Average product temperature | 146 [C] |
| Average effect | 1179 [kW] |

Fig. 3A (continued)

Gas conditions and equilibrium moisture content (only valid when heating)

| | |
|---|---|
| "Relative humidity atmosphere" without water supply | 1 [%] |
| Equilibrium moisture content without water supply | 0,0 [%] |
| Desired "relative humidity" in atmosphere | 10 [%] |
| New equilibrium moisture content ($T_{max}$160° C) | 0,1 [%] |
| Partial pressure steam | 1,4 [bar] |
| Dewpoint | 110 [C] |
| Necessary steam/water supply | 13 [kg] |
| Partial pressure gas | 12,87 [bar] |
| Pressure before heating | 8,1 [bar] |
| Mass of gas | 182 [kg] |
| Oxygen content if not evauated | 2,1 [%] |

Calculate

Fig. 3A (continued)

Product properties

| | |
|---|---|
| Product | Wood_Spruce |
| Product temperature (at which the properties are calculated) | 146 [°C] |
| Water content (at which the properties are calculated) | 12 [%] |
| Density | 527 [kg/m$^3$] |
| Specific heat capacity | 2,639 [kJ/kg-K] |
| Conductivity | 0,2173 [W/m-K] |

Fig. 3B

| Volume and flow velocity | | |
|---|---|---|
| Number of wood pieces horizontally | 11 | [-] |
| Number of wood pieces vertically | 17 | [-] |
| Number of wood pieces totally | 187 [-] | |
| Total product volume | 11,9 [$m^3$] | |
| Height stack | 1,12 [m] | |
| Width stack | 1,11 [m] | |
| Circulated gas volume | 6000 | [$m^3/h$] |
| Gas cooling - one pass(@ average effect) | 23 [K] | |
| Gas velocity across stack | 0,6 [m/s] | |
| Pressure loss across stack | 15 [Pa] | |

Fig. 3B (continued)

| Energy and effect | |
|---|---|
| Total volume thermal oil | 300 [L] |
| Thermal oil (energy requirement) | 7 [kWh] |
| Gas (energy requirement) | 2 [kWh] |
| Autoclave (energy requirement) | 49 [kWh] |
| Product | 114 [kWh] |
| Loss | 3 [kWh] |
| Totally | 172 [kWh] |
| Time at present condition (heating/cooling) | 1500 [s] |
| Time in hours and minutes | 0[h] 25 [min] |
| Average product temperature | 170 [C] |
| Average effect | 414 [kW] |

Fig. 3B (continued)

Gas conditions and equilibrium moisture content (only valid when heating)

| | |
|---|---|
| "Relative humidity atmosphere" without water supply | 2 [%] |
| Equilibrium moisture content without water supply | 0,0 [%] |
| Desired "relative humidity" in atmosphere | 10 [%] |
| New equilibrium moisture content ($T_{max}$160° C) | 0,1 [%] |
| Partial pressure steam | 1,4 [bar] |
| Dewpoint | 110 [C] |
| Necessary steam/water supply | 13 [kg] |
| Partial pressure gas | 12,87 [bar] |
| Pressure before heating | 11,6 [bar] |
| Mass of gas | 186 [kg] |
| Oxygen content if not evauated | 2,0 [%] |

Calculate

Fig. 3B (continued)

Product properties

| | |
|---|---|
| Product | Wood_Spruce |
| Product temperature (at which the properties are calculated) | 146 [°C] |
| Water content (at which the properties are calculated) | 12 [%] |
| Density | 527[kg/m$^3$] |
| Specific heat capacity | 2,639[kJ/kg-K] |
| Conductivity | 0,2173[W/m-K] |

Fig. 3C

| **Volume and flow velocity** | |
|---|---|
| Number of wood pieces horizontally | 11 [-] |
| Number of wood pieces vertically | 17 [-] |
| Number of wood pieces totally | 187 [-] |
| Total product volume | 11,9 [$m^3$] |
| Height stack | 1,12 [m] |
| Width stack | 1,11 [m] |
| Circulated gas volume | 6000 [$m^3/h$] |
| Gas cooling - one pass(@ average effect) | 7 [K] |
| Gas velocity across stack | 0,6 [m/s] |
| Pressure loss across stack | 15 [Pa] |

Fig. 3C (continued)

| Energy and effect | |
|---|---|
| Total volume thermal oil | 300 [L] |
| Thermal oil (energy requirement) | 2 [kWh] |
| Gas (energy requirement) | 1 [kWh] |
| Autoclave (energy requirement) | 16 [kWh] |
| Product | 42 [kWh] |
| Loss | 3 [kWh] |
| Totally | 61 [kWh] |
| Time at present condition (heating/cooling) | 1800 [s] |
| Time in hours and minutes | 0[h] 30 [min] |
| Average product temperature | 179 [C] |
| Average effect | 122 [kW] |

Fig. 3C (continued)

| Gas conditions and equilibrium moisture content (only valid when heating) | |
|---|---|
| "Relative humidity atmosphere" without water supply | 2 [%] |
| Equilibrium moisture content without water supply | 0,0 [%] |
| Desired "relative humidity" in atmosphere | 10 [%] |
| New equilibrium moisture content ($T_{max}$160° C) | 0,1 [%] |
| Partial pressure steam | 1,4 [bar] |
| Dewpoint | 110 [C] |
| Necessary steam/water supply | 13 [kg] |
| Partial pressure gas | 12,87 [bar] |
| Pressure before heating | 12,4 [bar] |
| Mass of gas | 188 [kg] |
| Oxygen content if not evauated | 2,0 [%] |

Calculate

Fig. 3C (continued)

Product properties

| | |
|---|---|
| Product | Wood_Spruce |
| Product temperature (at which the properties are calculated) | 146 [°C] |
| Water content (at which the properties are calculated) | 12 [%] |
| Density | 527 [kg/m$^3$] |
| Specific heat capacity | 2,639 [kJ/kg-K] |
| Conductivity | 0,2173 [W/m-K] |

Fig. 3D

| **Volume and flow velocity** | | |
|---|---|---|
| Number of wood pieces horizontally | 11 | [-] |
| Number of wood pieces vertically | 17 | [-] |
| Number of wood pieces totally | 187 [-] | |
| Total product volume | 11,9 [$m^3$] | |
| Height stack | 1,12 [m] | |
| Width stack | 1,11 [m] | |
| Circulated gas volume | 6000 | [$m^3/h$] |
| Gas cooling - one pass(@ average effect) | 20 [K] | |
| Gas velocity across stack | 0,6 [m/s] | |
| Pressure loss across stack | 20 [Pa] | |

Fig. 3D (continued)

| Energy and effect | |
|---|---|
| Total volume thermal oil | 300 [L] |
| Thermal oil (energy requirement) | 21 [kWh] |
| Gas (energy requirement) | 14 [kWh] |
| Autoclave (energy requirement) | 158 [kWh] |
| Product | 688 [kWh] |
| Loss | 0 [kWh] |
| Totally | 881 [kWh] |
| Time at present condition (heating/cooling) | 5700 [s] |
| Time in hours and minutes | 1[h] 35 [min] |
| Average product temperature | 30 [C] |
| Average effect | 556 [kW] |

Fig. 3D (continued)

Gas conditions and equilibrium moisture content (only valid when heating)

| | |
|---|---|
| "Relative humidity atmosphere" without water supply | 99 [%] |
| Equilibrium moisture content without water supply | 26,2 [%] |
| Desired "relative humidity" in atmosphere | 10 [%] |
| New equilibrium moisture content ($T_{max}$160° C) | 2,7 [%] |
| Partial pressure steam | 1,4 [bar ] |
| Dewpoint | 110 [C] |
| Necessary steam/water supply | 21 [kg] |
| Partial pressure gas | 12,87 [bar] |
| Pressure before heating | 19,9 [bar] |
| Mass of gas | 295 [kg] |
| Oxygen content if not evauated | 1,3 [%] |

Calculate

Fig. 3D (continued)

THERMO TREATMENT PROCESS FOR WOOD

This application claims the benefit of Danish Application No. PA 2016 70528 filed Jul. 15, 2016, which is hereby incorporated by reference in its entirety as if fully set forth herein.

FIELD OF THE INVENTION

The present invention is directed at a thermo treatment process for wood.

BACKGROUND OF THE INVENTION

In the art there has been suggested various methods for thermo treatment of wood as will be explained below. The purpose of subjecting wood to a thermo treatment is that it has for a long time been known that by treating wood under a certain temperature regime increasing the temperature for a period of time and thereafter reducing the temperature back to ambient temperature the wood attains some improved qualities. For example the durability as well as the insulating properties of the timber are improved. Laboratory tests have shown that this is due to a structural reordering of the molecular structure of the wood such that the wood from having a more or less random molecular fibre structure due the thermo treatment is reorganized to have a much more structured and linear fibre structure at the molecular level which provides for the improved characteristics.

These aspects are clearly disclosed and discussed in the "Thermo Wood® Handbook" published by the Finnish Thermo Wood Association in 2003. This book is widely considered as the reference work when it comes to thermo treatment of wood. According to the disclosure the process is divided into three phases where the wood which is placed in a treatment chamber is subjected to an increase inside the treatment chamber in two steps, first up to a temperature of approx. 100° C. for a first period and thereafter to a temperature of approx. 130° C. for a second period.

The purpose of the first phase is to dry out the wood and this phase lasts approx. 36 hours. In the second phase the temperature is further increased to between 185° C.-250° C.

The elevated temperature is maintained for approx. 16-17 hours in order for the wood to be subjected to the modification process as described above.

Finally, in the third phase a cooling and moisture conditioning phase is carried out where once the temperature has fallen below 80-90° C., a remoisturing of the wood takes place such that the moisture content in the treated and finished wood is in the range of 4-10% by weight. The third phase depending on the type of wood being treated typically takes 18-28 hours.

A method as discussed above is for example disclosed in EP 2 998 087 with a few modifications. According to the method in EP 2 998 087 wood is introduced into a treatment chamber in which the temperature is increased up to 173° C. and maintained for 3-5 hours. Thereafter the temperature is decreased to approx. 20° C., and the wood is transferred to an autoclave. In the autoclave linseed and mineral oil is introduced and allowed to penetrate the wood, which thereby becomes impregnated.

Wood mainly consists of three different components, namely hemicelluloses, celluloses and lignin. These materials have different characteristics and as such they react differently during the heat treatment. Hemicelluloses is special in that in the first part of the heating of the wood sample the modification of hemicelluloses is endothermic meaning that heat is transferred and absorbed by the wood until a certain temperature is reached.

This certain temperature is depending on the type of wood and thereby also the contents of hemicelluloses which varies depending on the species and the growth conditions for that particular species as well as the moisture content and the pressure, but it will typically be around 230° C.

At this temperature the modification of hemicelluloses turns from an endothermic process to an exothermic process, i.e. more energy is generated than what is added to the hemicelluloses component of the wood. At the same time the celluloses will have been modified and will still he undergoing modification. Typically, the cellulose part of a wood sample will be substantially larger than the hemicelluloses part, and a such a substantial part of the wood has been modified at this stage.

A number of drawbacks, however, are associated with the prior art methods and procedures.

Firstly, the procedure takes a very long time thereby reducing the output from a process plant. Typically, a treatment of a batch of wood with prior art methods takes from 24 hours and up to 36 hours depending on the wood and how aggressive the modification process is pursued.

The very long process time and thereby the low turnover in the machinery naturally increases the cost of the modified wood due to the long process time. Furthermore, traditional modification processes use steam and heated steam in order to increase the heat inside the wood and there thereby activate the modification process. As there is already moisture inside the wood and the wood is not absolutely homogenous there will be a non-even distribution of moisture inside the wood and at the same time the wood may not have a completely homogenous structure.

This does cause problems to the quality of treated wood in that as the moisture inside the wood is heated, steam will be generated and due to the variations both in moisture content and the wood structure as well as the variation of density in the wood to be treated the internal pressure inside the wood due to the heating will cause cracks and other detrimental side effects during the treatment. As the treatment chamber has a relative high steam pressure, the built up pressure inside the wood cannot dissipate slowly, but will eventually cause a small steam explosion, potentially causing cracking or other damage. At the same time miscolouring of the surface may be a result.

In order to improve this, it has been suggested in JP2013180460 to replace the air and steam inside the treatment chamber by a super critical carbon dioxide atmosphere. Super critical carbon dioxide is in the Japanese reference defined as carbon dioxide beyond a critical point which is described as being 31° C. at 7.4 MPa.

When the carbon dioxide is in a super critical state, it acts like a fluid and as such together with the very high pressure (above 74 bar) it replaces the moisture inside the wood structure. In order to remove the moisture from the wood it is necessary to further heat the super critical carbon dioxide atmosphere in order to transform moisture, typically water, from its liquid to its gaseous state, i.e. steam. This in turn causes the pressure to increase even more. This process therefore has a number of drawbacks, firstly the vessel in which the process is to be carried out must be extremely strong in order to be able to withstand the very elevated pressure inside the treatment chamber.

Furthermore, any generation of steam exposed to such a high pressure will have a severely detrimental effect on any imperfections such as cracks, nuts and the like in the wood, thereby causing the wood to crack or split.

OBJECT OF THE INVENTION

Consequently, there is a need for a process which is faster and has improved durability characteristics as compared to the prior art methods.

DESCRIPTION OF THE INVENTION

The invention addresses this by providing a thermo treatment process for wood comprising the following steps:

a. Placing the wood batch to be treated in a treatment chamber;
b. Exchanging the atmosphere inside the treatment chamber by evacuating the air, replacing the evacuated air by an inert gas atmosphere in gas form, at 8 to 12 bar pressure;
c. Heating the inert gas atmosphere up to 165 to 175° C.,
d. increasing the pressure in the inert gas atmosphere to 14-16 bar;
e. maintaining the temperature in step c. and the pressure in step d. for from 90 to 150 minutes;
f. cooling the inert gas atmosphere to a temperature of 20 to 35° C.
g. retrieving the treated wood batch.

With this process a relatively low pressure is maintained inside the treatment chamber.

At the same time, by replacing an atmosphere containing steam by an atmosphere of an inert gas atmosphere, and particularly in a preferred embodiment where the inert gas is nitrogen, the heat exchange capabilities between the treatment atmosphere and the wood is increased substantially. Steam's heat exchange capabilities are relatively poor up until approx. 140° C., whereas for example for nitrogen its heat exchange capabilities are substantially constant throughout the temperature interval and at the same time much better than what is the case with steam.

Therefore, it is possible to heat the atmosphere and thereby the wood inside the treatment chamber much faster and the heating process is only limited by the available apparatus for heating the gas and the ability of the heat to travel through the wood such that the core temperature of the wood reaches the desired treatment temperature.

Furthermore, as no steam is added there is no steam pressure, and any moisture present in the wood will simply be replaced and absorbed by the inert gas atmosphere without causing steam explosions or other steam expansion processes. Furthermore, due to the difference between the moisture/steam present in the wood and the inert gas preferably nitrogen it is achieved that substantially the entire water based moisture content in the wood is replaced by the inert gas, i.e. is removed from the wood. At the same time due to the temperature increase the modification processes as discussed above specifically with reference to hemicelluloses and celluloses is progressing.

As the gas also after the modification process is the same and still has the same heat exchange capabilities it is also possible to cool the treatment chamber and thereby the wood very quickly such that an overall improved process is provided with a minimum of process time. Instead of the 36-68 hours for the traditional treatment time, the present invention carries out a full cycle that takes approx. 5-6 hours.

In a further advantageous embodiment the process in step c and d together takes between 90-110 minutes. These steps may be carried out simultaneously or they may be carried out as independent steps depending on the process equipment available and how the temperature increase is achieved and how the pressure increase is achieved. Even though a very good heat exchange coefficient is present when the atmosphere is replaced with a nitrogen atmosphere it is still necessary to moderate the heat increase in order not to get problems relating to temperature expansion coefficients and the like.

In a further advantageous embodiment a mineral or organic oil for impregnating the wood may be applied. As the wood at this point is completely dry, all the moisture has been replaced by the inert gas/nitrogen it is possible to make the oil penetrate very deeply into the wood and thereby achieve a very good preservative effect.

Naturally the mineral or organic oil has to be designed such that the molecule size and structure is able to penetrate the wood structure which is different from species to species and at the same time the mineral oil may be modified with various compounds in order to give long lasting effect, fungicidal properties etc.

In another alternative embodiment an impregnating agent may be applied. The impregnating agent may be based on any base material, for example a water based impregnating agent or other solvent free impregnating agents or even a solvent based impregnating agents known per se in the art.

DESCRIPTION OF THE DRAWING

The invention will now be described with reference to the accompanying drawing in which.

DETAILED DESCRIPTION OF THE INVENTION

The invention as already discussed above has two main goals, firstly to reduce the cycle time, i.e. the time that is necessary in order to thoroughly treat a batch of wood and secondly to improve the quality of such treatment, such that the batch of wood received an improved treatment and with less risk of damaging the wood structure during the treatment process.

By replacing the traditional water based atmosphere, i.e. steam inside the treatment chamber by an inert gas, it is possible to separate pressure and temperature in the heating and cooling phase. In prior art methods a pressure is created by producing steam by heating up water. This process is time consuming since the increase in steam pressure lacks behind the temperature increase. A requirement in the treatment chamber is that the relative humidity must be kept above 85% RH in order to avoid or minimize damage to the wood. This delay causes a very slow increase in pressure as a function of temperature, particularly at low temperatures. At the same time requiring relative high energy consumption.

Figure 1:
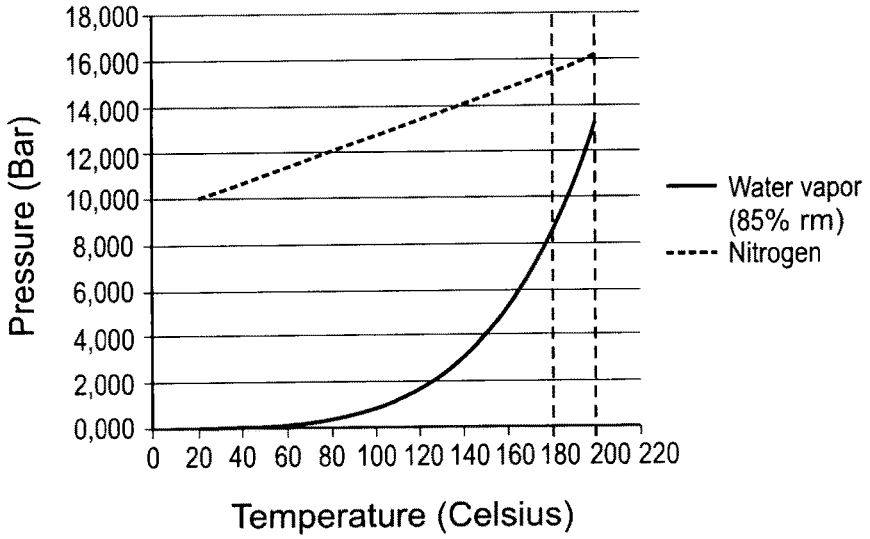
FIG. 1 illustrates how pressure builds up very slowly with steam at temperatures below 140° C.

In FIG. 1 is illustrated how pressure builds up very slowly with steam at temperatures below 140° C. From 30° C. to 140°/170° C., which is the temperature range where most of the heating and cooling takes place for the inventive method and as such it can be seen that there is a distinctive difference in the inert gas' ability to heat exchange with the wood as compared to steam (at least for the particular temperature range). As the temperature and pressure building is not connected with an inert gas it is possible to heat and cool the gas as fast as the system allows and control the pressure inside the treatment chamber separately.

Figure 2:
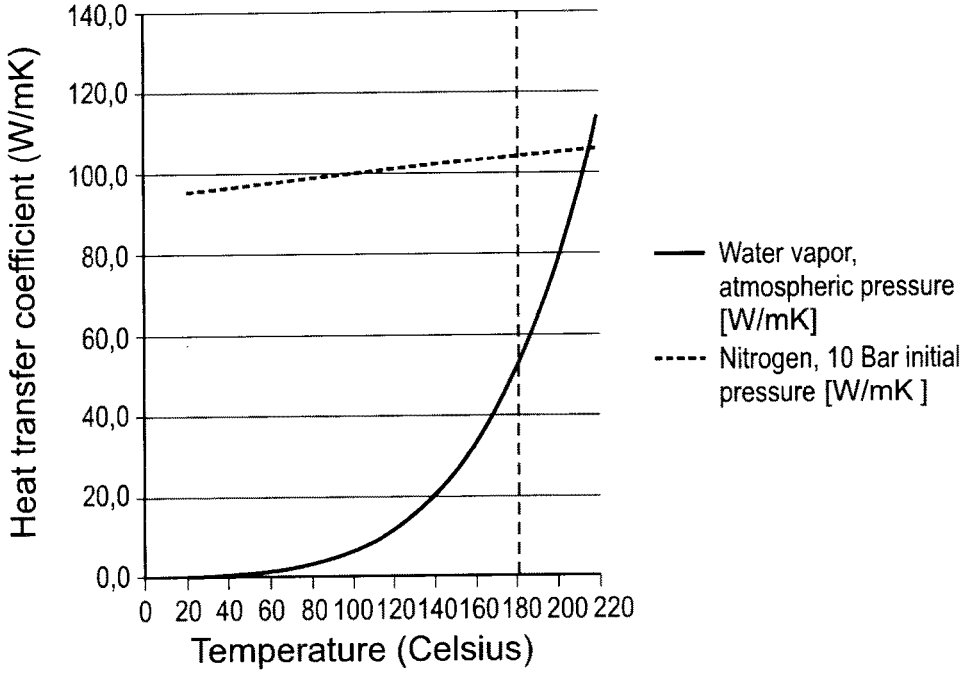
FIG. 2 use of an inert gas as compared to steam
Figure 3A:
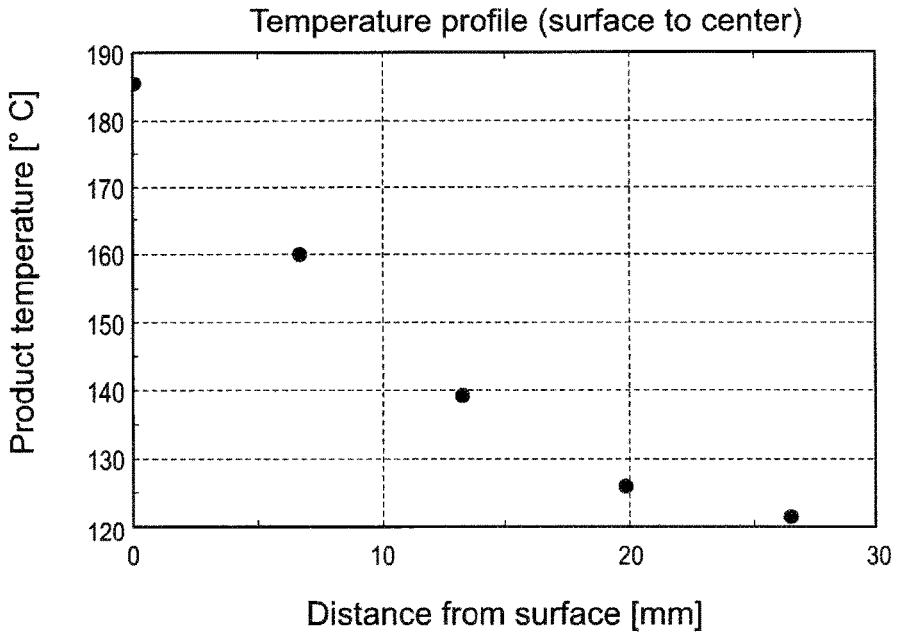
FIG. 3A-3D illustrate readouts from the inventive method at different stages through the method.
Figure 3A:
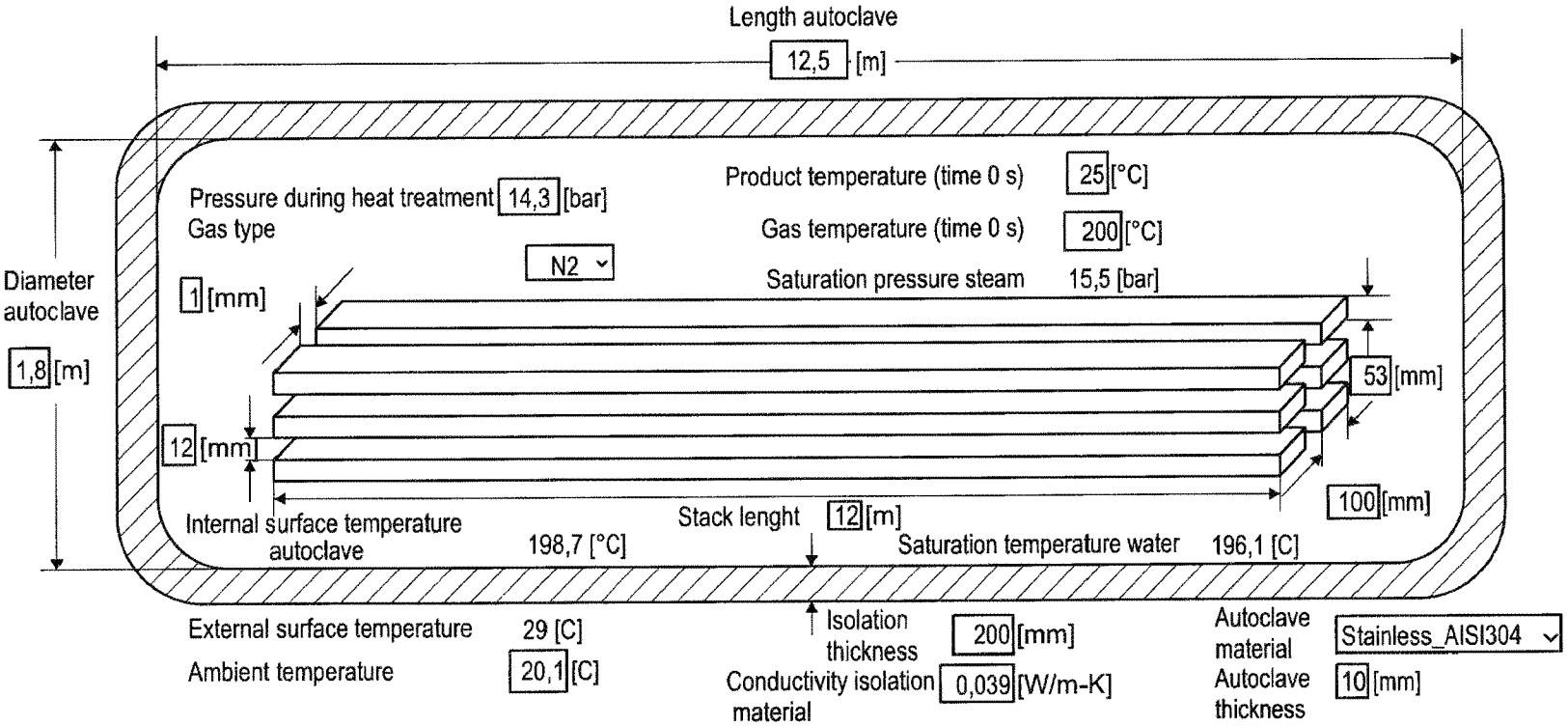
Figure 3B:
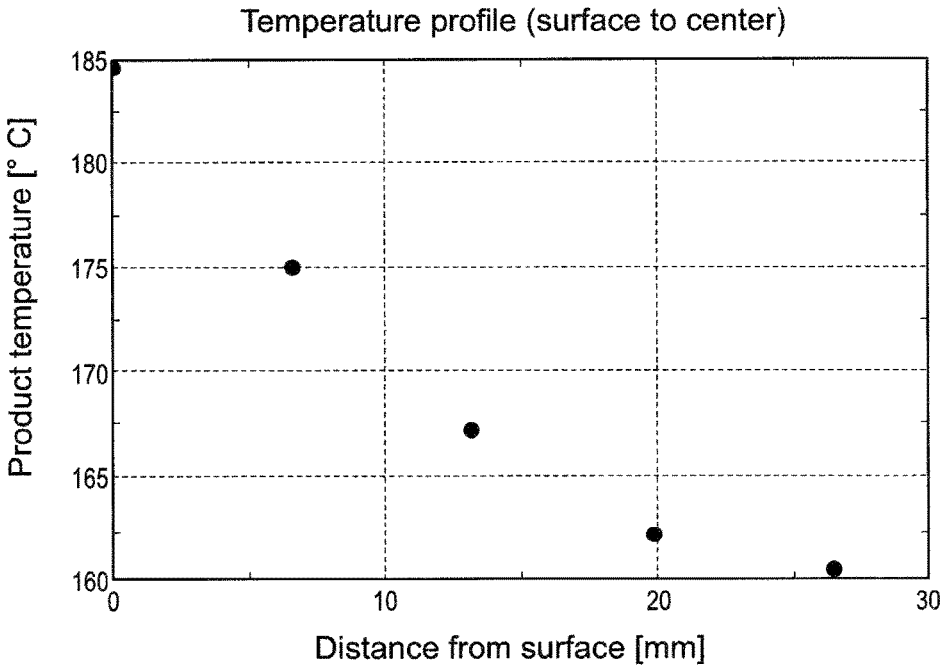
Figure 3B:
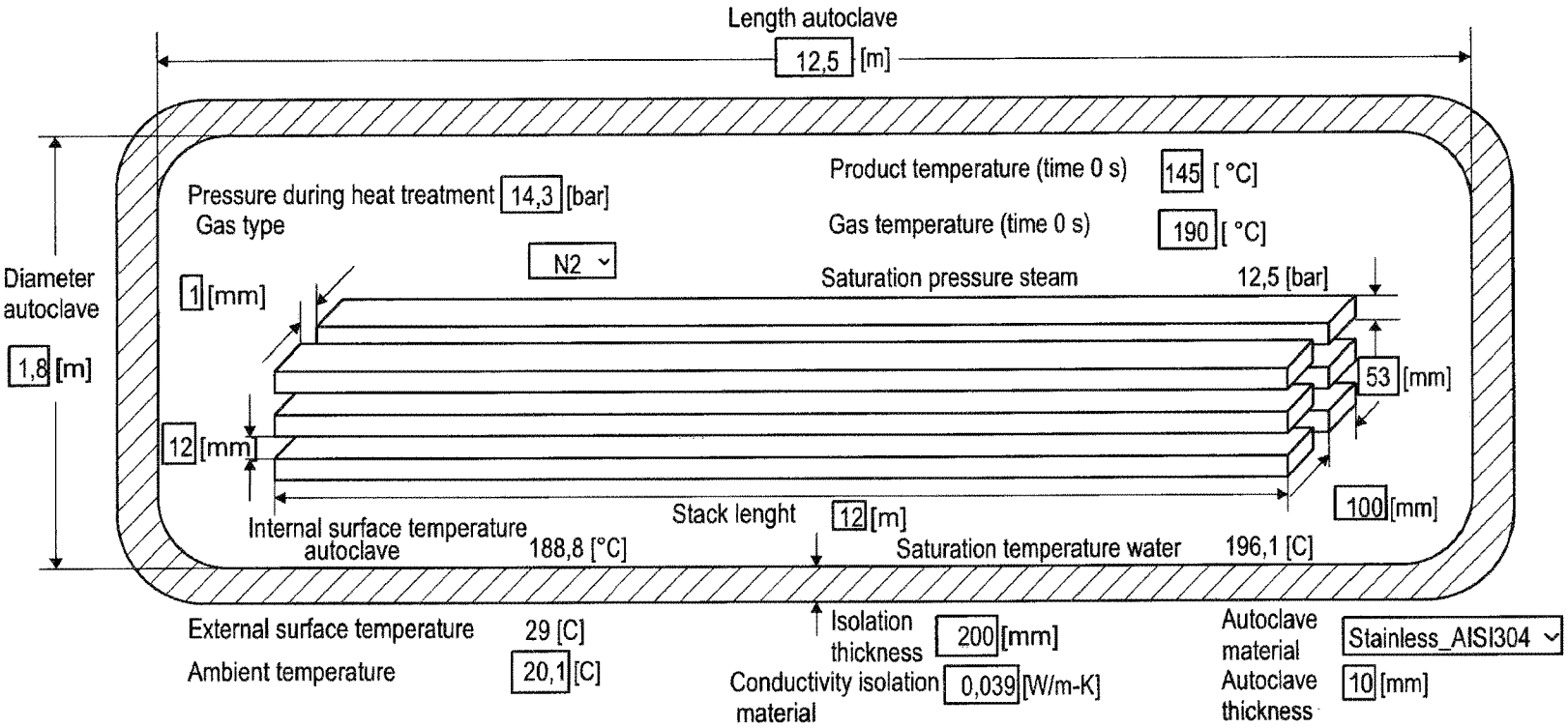
Figure 3C:
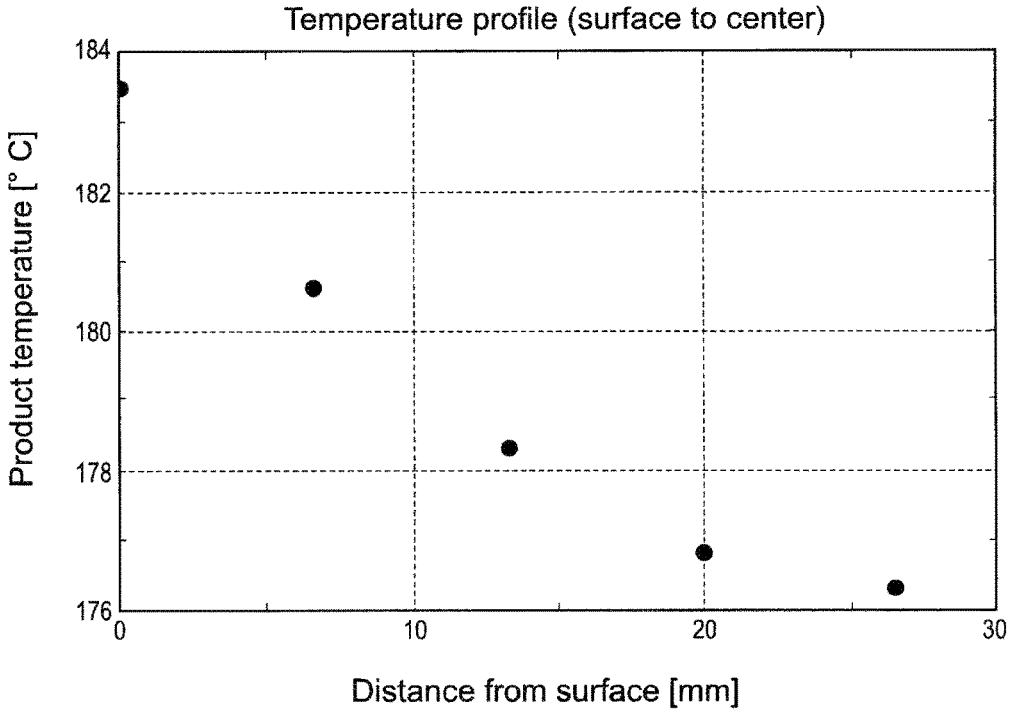
Figure 3C:
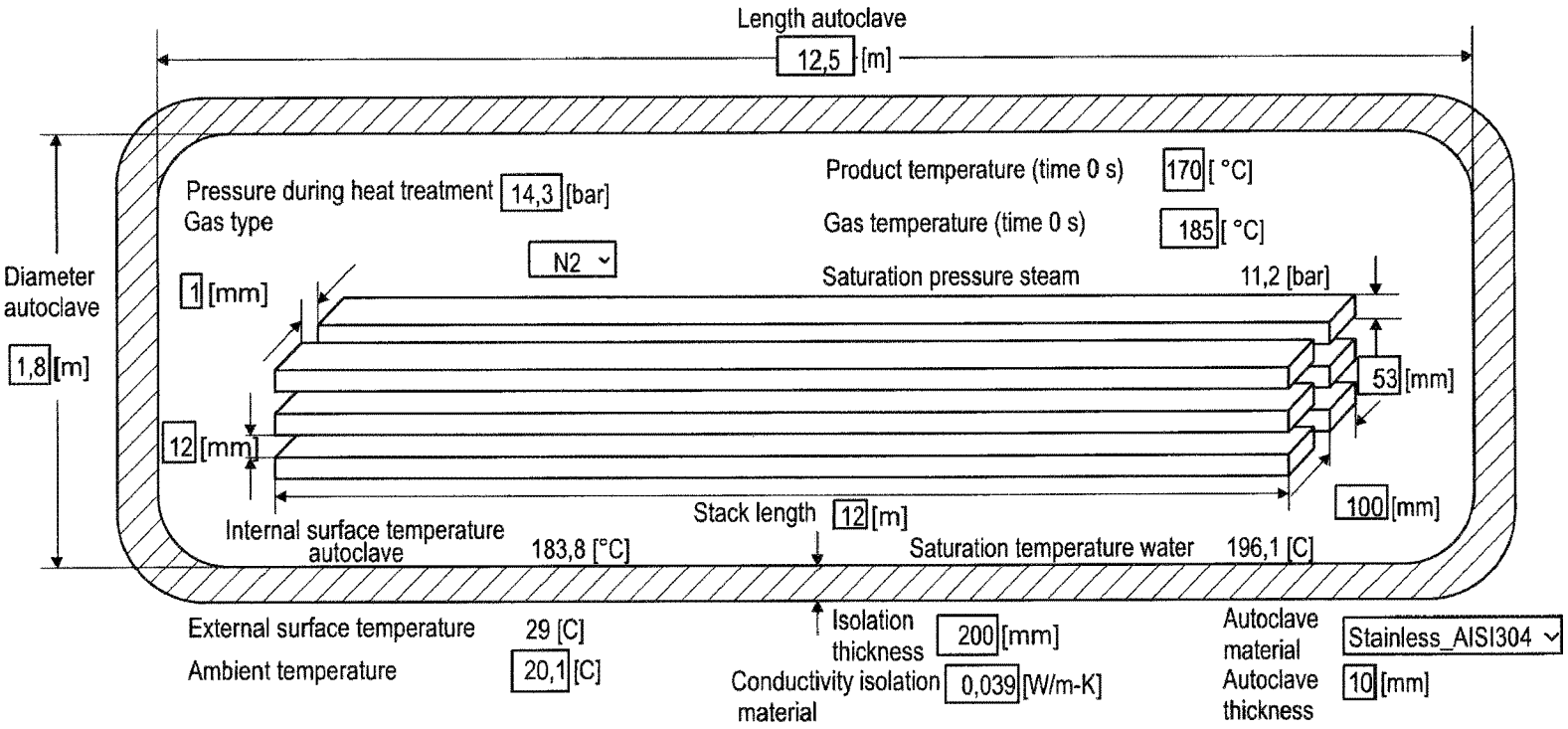
Figure 3D:
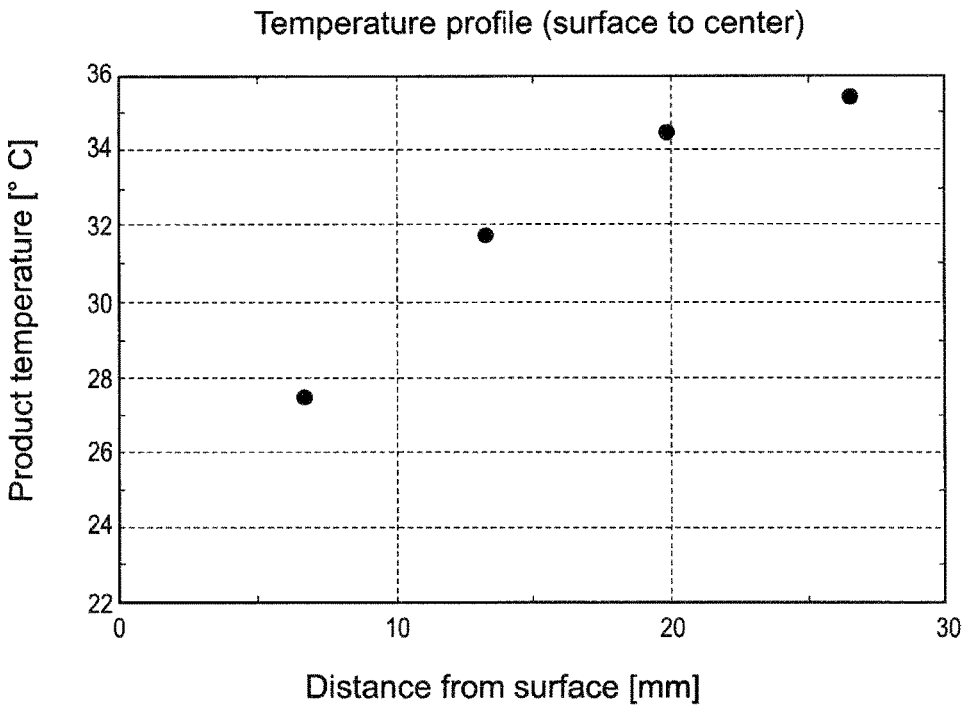
Figure 3D:
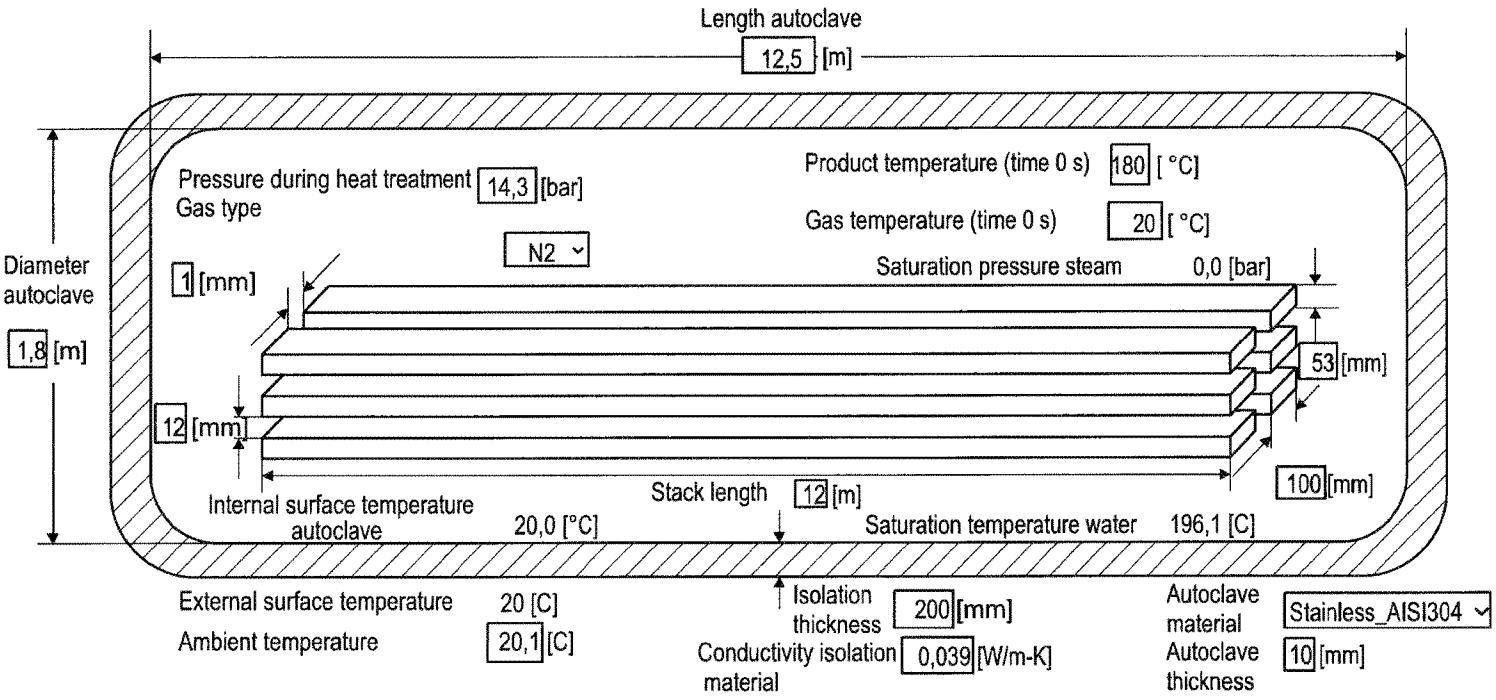

The use of an inert gas as compared to steam also increases the heat exchange with the wood such that it heats up faster. This is illustrated in FIG. 2 where it is clear that the rate of energy transfer between steam and wood as compared to nitrogen and wood is distinctively better for nitrogen and as such it is possible to transfer/exchange heat at a much higher rate using nitrogen (or an inert gas) than when using steam.

As discussed above one of the main drawbacks with prior art methods is the high risk of creating cracks in the treated wood.

These cracks emerge in any situation where the difference between the partial pressure inside the wood cells and the outside atmosphere is large enough to cause the cracks to develop. In the prior art heat treatment methods, it must be remembered that there is water present inside the wood, typically 10-14%. As the steam atmosphere and the wood is heated up, steam pressure builds up both inside and outside of the wood. Cracks typically develop in the following situations:

- In the heating phase, if the relative humidity (RH) of the steam atmosphere outside the wood becomes too low when heating up the atmosphere. In this situation, the partial pressure inside the wood may become larger than that outside the wood. Depending on the size of the relative overpressure inside the wood and other parameters such as wood species, cracks may result.
- In the modification phase, when the hydrolysis of the hemicelluloses becomes exothermic. Depending on wood species, thickness of the boards being treated, moisture content and other parameters, temperature in the core of the wood quickly increases, typically 15 to 25° C. above the temperature of the surrounding steam atmosphere. This can lead to significant differences in relative pressure, illustrated in FIG. 1. In FIG. 1, the pressure of steam in a closed system is shown as a function of temperature. Modification in prior art methods typically runs at 180° C., which corresponds to a pressure of 8.5 Bar at 85% RH. At 200° C., the pressure is 13.2 Bar. Since the exotherm develops in the center of the wood, in this case a relative overpressure in the center of the wood of (13.2-8.5) 4.7 Bar develops very quickly. These thermodynamics created by the hemicelluloses exotherm represent a major cause for potential cracks and quality problems in prior art heat treatment methods.
- In the cooling phase, if the temperature gradient in the wood becomes too steep. As illustrated in FIG. 1, if the steam atmosphere is cooled too fast, especially in the beginning of the cooling phase when temperature is still high, the relative pressure in the steam will drop quickly relative to the still hot center of the wood. In this case a relative overpressure may build in the wood, leading to cracks.
- Beside cracks, the presence of steam has also been reported to create other quality problems such as water stains and discoloring from condensates.

All of the above mentioned dysfunctional partial pressure thermodynamics of prior art methods are effectively eliminated by the invention, in two ways:

- In the initial vacuum and pressure phase, atmospheric air with its content of oxygen is removed from the wood cells and replaced by a condensed Nitrogen atmosphere at 10 Bar. At 10 Bar, the boiling point of water is approximately 180° C., so that the water in the wood is far below its boiling point. At 180° C., the pressure of Nitrogen has increased to approximately 15 Bar, so that the water in the wood is still kept below its boiling point. Thus the water present in the wood is far below its boiling point during the entire process, so that no significant partial steam pressure can build as temperature is increased.
- In the hemicelluloses exotherm, Nitrogen will not build significantly higher partial pressure inside the wood, as the temperature in the center increases. FIG. Y below clearly illustrates that while steam pressure increases exponentially in the high temperature range, Nitrogen pressure only increases moderately in a linear manner. An increase in wood core temperature from 180 to 200° C. will lead to an overpressure of (16.1-15.4) 0.7 Bar for Nitrogen, compared to 4.7 Bar for steam.

In FIG. 3A-3D, illustrating readouts from the inventive method at different stages through the method, it is clear to recognize the effects of the present invention.

The invention claimed is:

1. Thermo treatment process for wood comprising following steps:

a. Placing a batch of wood to be treated in a treatment chamber;
b. Exchanging atmosphere inside the treatment chamber by evacuating air and steam, replacing evacuated air and steam by an inert gas atmosphere in gas form, at a pressure of from 8 to 12 bar;
c. Heating the inert gas atmosphere up to a temperature of 165 to 175° C.,
d. increasing the pressure in the inert gas atmosphere to 14-16 bar;
e. maintaining the temperature in step c. and the pressure in step d. for a time period of from 90 to 150 minutes;
f. cooling the inert gas atmosphere to a temperature of 20 to 35° C.
g. retrieving the batch of wood treated in the treatment chamber.

2. Thermo treatment process for wood according to claim 1, wherein the inert gas is Nitrogen.

3. Thermo treatment process for wood according to claim 1 wherein the process in steps c. and d. takes between 90 to 110 minutes.

4. Thermo treatment process for wood according to claim 1 wherein in step d. or e. a mineral or organic oil may be applied to the batch of wood.

5. Thermo treatment process for wood according to claim 1 wherein an impregnating agent is applied to the batch of wood in step d. or e.

* * * * *